US006102628A

United States Patent [19]

Maity et al.

[11] Patent Number: 6,102,628

[45] Date of Patent: Aug. 15, 2000

[54] ARCH USEFUL FOR WITHSTANDING EFFECT OF ROCKBURST OCCURRING IN UNDERGROUND MINES/TUNNELS

[75] Inventors: Sibnath Maity; Bharat Bhushan Dhar; Pinaki Ranjan Ghosh, all of Dhanbad, India

[73] Assignee: Council of Scientific & Industrial Research, New Delhi, India

[21] Appl. No.: 09/052,367

[22] Filed: Mar. 31, 1998

[51] Int. Cl.[7] ..... E21D 15/22; E21D 15/502; E21D 15/56

[52] U.S. Cl. ..... 405/288; 405/259.1

[58] Field of Search ..... 405/258, 259.1, 405/288, 302.2

[56] References Cited

U.S. PATENT DOCUMENTS

| | | | |
|---|---|---|---|
| 1,821,020 | 9/1931 | Mensforth | 405/288 X |
| 2,036,490 | 4/1936 | Neilson et al. | 405/288 |
| 2,713,774 | 7/1955 | Heintzmann et al. | 405/288 |
| 2,749,713 | 6/1956 | Paurat | 405/299 |
| 3,126,708 | 3/1964 | Jasper | 405/288 |
| 3,168,815 | 2/1965 | Blenkle et al. | 405/288 |
| 3,395,542 | 8/1968 | Deloffre . | |
| 4,173,421 | 11/1979 | Harhoff et al. | 405/288 X |
| 4,334,800 | 6/1982 | Stuckmann | 405/288 X |
| 4,997,317 | 3/1991 | Schönfeld et al. | 405/288 |

FOREIGN PATENT DOCUMENTS

| | | | |
|---|---|---|---|
| 2624233 | 12/1977 | Germany | 405/302.2 |
| 0875068 | 10/1981 | U.S.S.R. | 405/302.2 |

*Primary Examiner*—Eileen Dunn Lillis
*Assistant Examiner*—Tara L. Mayo
*Attorney, Agent, or Firm*—Foley & Lardner

[57] ABSTRACT

An arch useful for withstanding effects of rock burst occuring in underground mines/tunnels. The arch comprises a curved U-section arch provided on both ends with slidingly coupled U-section arch pieces, the coupled top and bottom pieces being provided with at least two guides on both sides. The guides are slidingly coupled with the bottom section aches, the ends of the top section arch being placed on upper holder plates, the upper holder plates being fixed with the bottom sections on both sides. The bottom portion arches also having at least one lower pair of holder plates fixed on both sides below the upper holder plates.

10 Claims, 3 Drawing Sheets

ARCH USEFUL FOR WITHSTANDING EFFECT OF ROCKBURST OCCURRING IN UNDERGROUND MINES/TUNNELS

FIELD OF THE INVENTION

This invention relates to arch useful for withstanding effect of rockburst occurring in underground mines/tunnels. This invention, particularly, relates to a steel arches capable of yielding instantly under sudden impact such as to cushion the effect of rockburst occurring in underground mines/tunnels in such a manner so as to avoid distortion of the roof arch.

BACKGROUND OF THE INVENTION

A rockburst is defined as any sudden and violent explosion of rock from its surroundings. The phenomenon results from the static stress exceeding the static strength of the rock, and the result being sudden rockburst of sufficient magnitude, which creates safety and engineering problems in underground mines/tunnels.

A "bump" is defined as a strong seismic shock resulting from a failure or a sudden displacement at some point in the rock surrounding an underground opening.

Rockburst has long been a major problem especially for the mining industry all over the world. Excavation at greater depth is generally coupled with the chance of outburst of rock mass whatever may be the design of opening or precaution taken from the rock mechanics point of view. At the time of rockburst, the impact of dynamic loading of the roofrock is excessively high.

Usually, smaller bursts occur in openings of limited size, such as tunnels, development drifts or shafts, whereas larger bursts are more likely to happen in extensively mined areas.

PRIOR ART REFERENCES

As per the report prepared by the Rockburst Committe, Ontario, (Canada Mine Association), the fatalities in the Kolar (India) Gold Field by rockbursts accounted for over 50% of the total fatalities in a three year period of study.

In the prior art, there are a few references for underground mines/tunnels support systems. We give herebelow such prior art references for easy understanding. German Patent No. DE 4000393 describes a roof and walls of a tunnel or mine gallery, supported by arches made from steel sections with a bell shaped cross-section. Each arch is constructed from a number of curved elements fastened end to end.

The space between the arch and the surrounding catch is filled with a flexible hose made from woven material. This hose is filled with an initially soft material which hardens after being placed inside the flexible hose. The hose is placed in position with the aid of a rope which is fastened to the hose by means of loops of cord which encircle the hose. However, this mainly concerns the flexible hose arrangement filled with soft material for filling the space between arch and surrounding catch and the above arrangement does not effectively withstand the rockburst occurring in underground mines/tunnels as well as the shocks produced by such rockburst.

Another Patent No. SU 1051300 A describes a mechanism for supporting and securing a coal face cut by a combine that reduces effort and time. The mechanism includes a frame corresponding to the face shape and fitted with hinged ties attached to the combine. The frame is lifted by jacks. A pressure nut mounted above the combine includes a front edge and the face support carrying unit and anchor drills are mounted on the sides.

The removed coal is transferred by loaders and a conveyor. The support positioner is moved on a monorail above the loaders and the conveyor.

The positioner has wings hinged to a central section and fixed in position by cylinders. The flexible ties are folded mounted on the rods and the assembled packets fixed at the ends. The central section of the mechanism is fitted with the removable supports and split hinges between the wings and the frame in order to use the mechanism for various types of supports including a steel arch with a tailor made profile. Unfortunately, the above mechanism is a complicated one involving heavy parts/means. In addition, this mechanism does not effectively withstand the effect of rockburst occurring in underground mines/tunnels. Further, the Applicants' present invention does not relate to this type of mechanism.

Yet another, Patent reference DE 3236423 describes a gallery support system, with backfilling for support of rock in cavities and galleries, especially, those exposed to effects of extraction in underground mining and tunneling. It comprises steel arches, at an interval from the rock, together with warping or lagging spanning the gaps, and backfilling. The backfilling is in resilient form overall. It can consist of plastic, or semi-plastic non-hard-setting material. This may be clay or limestone sand, with oil or bitumen. The steel arches and warping or lagging may form an entity, restraining the backfilling, preferably, with filler openings at a number of points. However, the above construction relates to the backfilling system with plastic or semiplastic, non-hard setting material in resilient form. This construction also does not effectively withstand rockburst and the shock waves produced by the rockburst. The above construction buckles down when the rockburst occurs.

Still another Patent reference DE 244327 B describes a circular tunnel or mine heading supports and insertion system for use in full section operations where the face of the heading is at a slant to provide support in association with a forepoled bar serving as a support for the permanent steelwork to carry the tunnel. Channel section forepoled bars are installed along the abutment lines with the aid of stiff and directed connections. The bars form a connection which is proof against tensile or compressive stresses and are embedded in the freshly placed support concrete as a permanent component in the steel arch support system. This Patent discloses bars from a connection which is proof against tensile or compressive stresses developed within the steel arch type support system. This system is a rigid one and does not effectively withstand the rockburst and shocks produced by such rockburst.

Further, it is admitted in the mining industry that rock properties and geological features are factors over which the engineer has no control. Also, because the stress increases with depth, it is inevitable that such burst problems will be encountered in deep mining. To some degree, the frequency or severity of burst can be mitigated through the application of the mining techniques such as orientation of extraction, leaving remnant pillars within the extracted area, back filling the extracted void by inducing additional fracture in the rock ahead of the face etc.

But there are no provisions for supports in the underground working to resist the outburst of rock mass. As it is the sudden release of high impact, the conventional supports like wooden props, steel props, steel arches cannot withstand the rockburst effect. Even the yielding arches and hydraulic props get shattered at the time of sudden shock, because the rate of yield of the above supports can not cope with shock waves from outburst.

Therefore, till now, there is no support available which can either provide resistance or yield fast enough to absorb the stock waves at the time of outburst of rock mass. It is only possible if an arch provides very high rate of yielding all of a sudden, which will provide enough cushion space for the downward advance of bursted loose rock and thereby inherent stresses in the rock will be released and the support will be safe at least for quite a considerable time, even if the burst is prolonged, such that the miners/workers can be saved.

OBJECTS OF THE INVENTION

The main object of the present invention is to provide an arch, preferably made of steel, useful for withstanding the effects of rockburst occurring in underground mines/tunnels.

Another object is to provide a yielding type steel arch which can yield immediately and sufficiently under sudden impact load, but will yield slowly with gradual rate of loading.

Yet another object of the present invention is to provide an economic, rapid yielding arch which will help sudden release of confined stress of surrounding rock mass without affecting the arch itself i.e. no mechanical failure/distortion of the arch and thereby keeping safely inside the arch.

SUMMARY OF THE INVENTION

The above objects are achieved by an arch, preferably made of steel, useful for withstanding effects of rock burst occuring in underground mines/tunnels, which comprises a curved U-section arch provided on both ends with slidingly coupled U-section arch pieces, the coupled top and bottom pieces being provided with at least two guides on both sides, the said guides being fixed by means with the top section arch which is slidingly coupled with the bottom section arches, the ends of the top section arch being placed on upper holder plates, the upper holder plates being fixed with the bottom sections on both sides by means, the bottom portion arches also having one or more pairs of lower holder plates being fixed by means on both sides below the upper holder plates.

BRIEF DESCRIPTION OF THE ACCOMPANYING DRAWINGS RELATING TO THE PRESENT INVENTION

In FIGS. 1 to 6 of the drawings accompanying this specification, the device of the present invention is illustrated.

DETAILED DESCRIPTION

Figure 1:
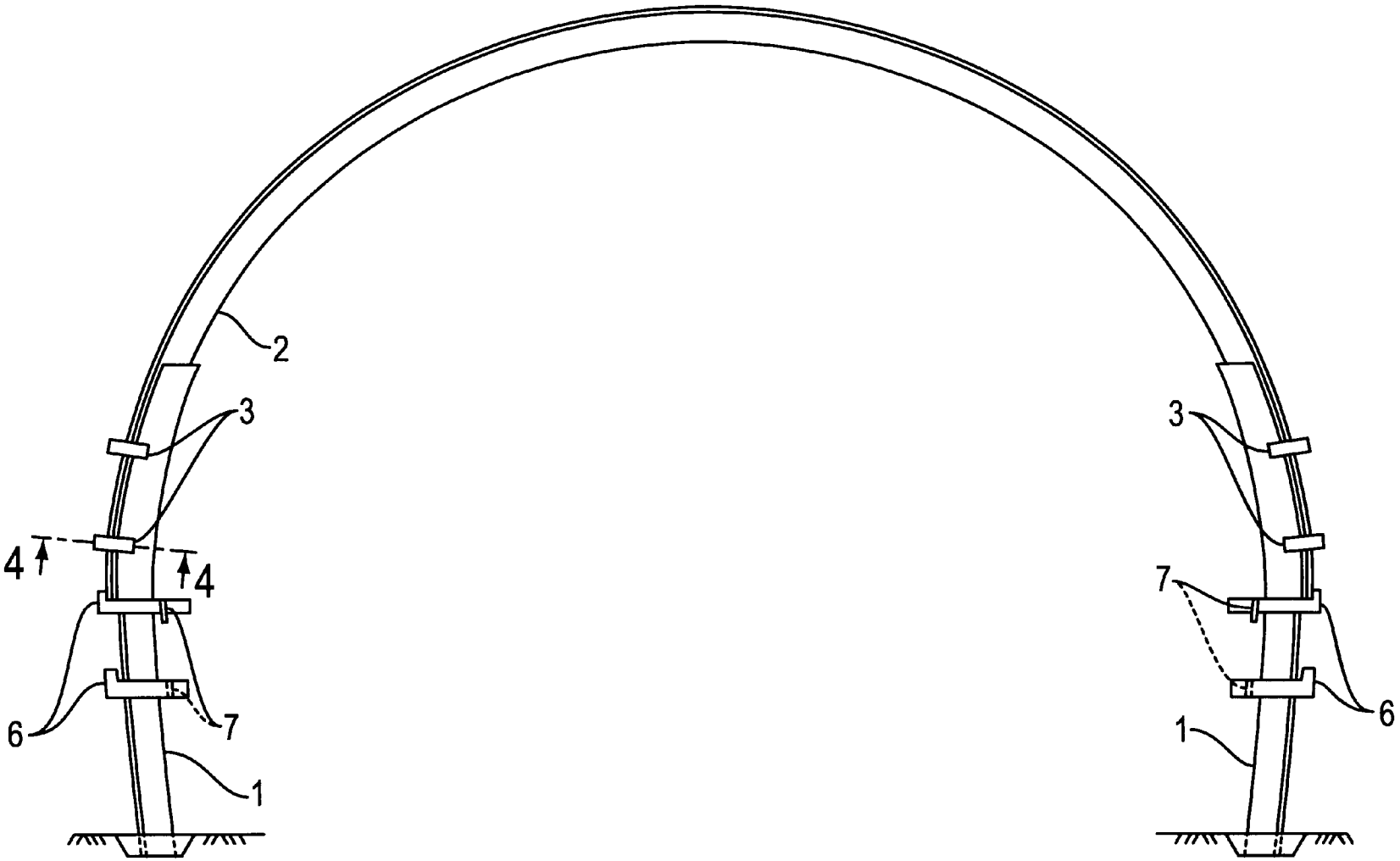
FIG. 1 shows the schematic assembled diagram of the device of the present invention.
Figure 2:
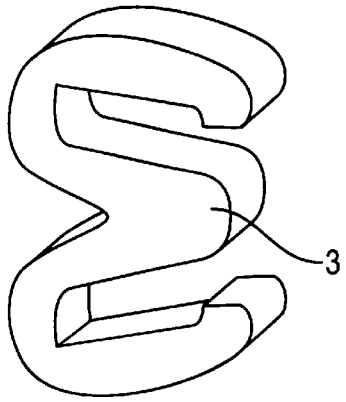
FIG. 2 shows the schematic diagrams of the sliding guide used in the device.
Figure 3:
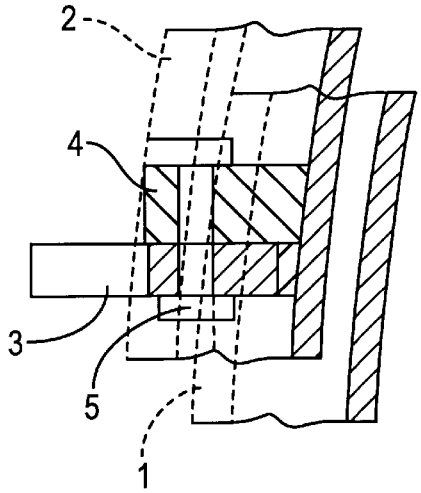
FIG. 3 shows the sectional view of the guide assembly (through 3—3 of FIG. 4).
Figure 4:
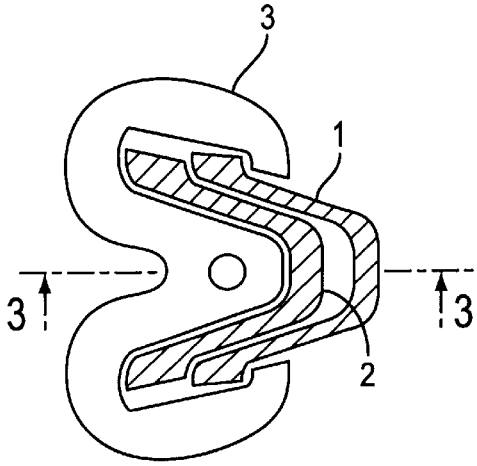
FIG. 4 is a sectional view of the invention taken along line 4—4 in FIG. 1.
Figure 5:
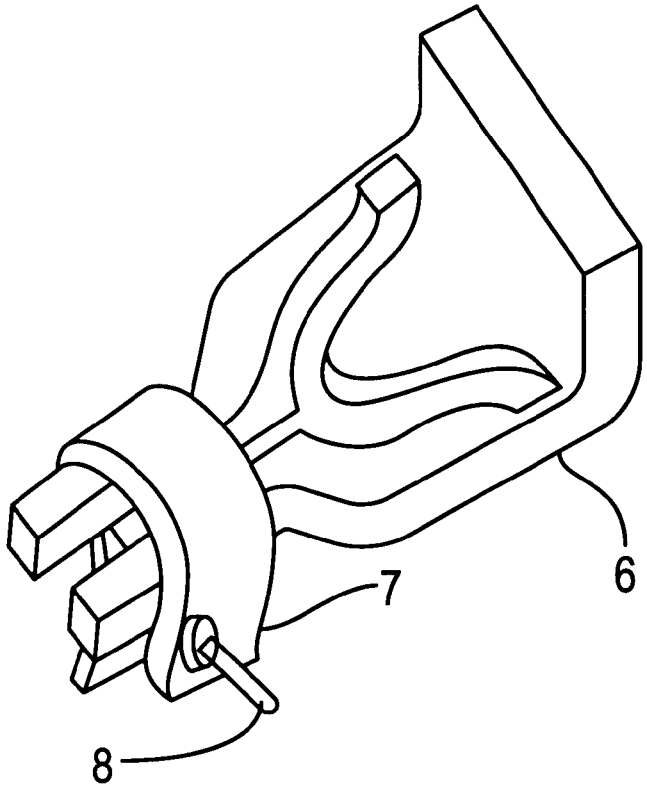
FIG. 5 shows the holder plate assembly of the device in perspective.
Figure 6:
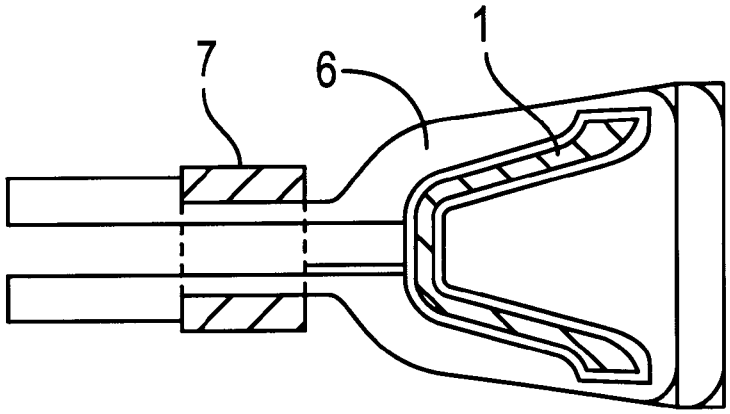
FIG. 6 shows the plan view of the holder plate assembly (partially sectional).

Accordingly, the present invention provides an arch, preferably a steel arch useful for withstanding effects of rockburst occurring in underground mines/tunnels, which comprises a curved U-sectional arch (2) which is provided on both ends with slidingly movable couplings suitable for fixing with U-section arch pieces (1), the coupled top and bottom pieces (1 & 2) being provided with at least two guides (3) on both sides, the said guides (3) being fixed by means (4 & 5) with the top section arch (2) which is slidingly coupled with the bottom section arches (1), the ends of the top section arch (2) being placed on upper holder plates (6), the upper holder plates being fixed with the bottom sections on both sides by means (7 & 8). The bottom portion arches (2) also have one or more pairs of lower holder plates (6) fixed by means (7 & 8) on both sides below the upper holder plates. The preferred means (4 & 5) and (7 & 8) used in the construction of steel arch of the present invention are nut and bolt arrangements. However, the above means are not restricted to such nut and bolt arrangements only since the above means could be fixed by any conventional arrangement/system such as welding or gluing.

The guides (3) are "M" shaped wherein the ends of the arms are sligtly curved inwardly.

The present invention incorporates an improvment in the yielding process of U-section sliding type arch, such that there will be rapid yielding all of sudden under high impact load providing considerable closure of the arch and also it can withstand the subsequent shocks, if any, in the same way, and thereby can provide a safe shelter for the miner/workers who get trapped at the time of rock bursts.

The device of the present invention is an improved steel arch which is different than the conventional non-yielding or slow-yielding arch in many points. The top sectional arch (2) is not directly fixed by clamp arrangement (like conventional yielding arch) rather it is slidingly coupled with the bottom piece (1) and simply placed on holder piece (6) fixed with the lower portion (1) on both sides.

If the loading on the piece of the arch is gradually increasing then the clamp (6) of the holder plate will start yielding after crossing the yield load (say 30 tonne for each leg) which may be fixed at the time of tightening and as per the safe capacity of the arch. But if the active load is more than 60 tonne (i.e. exceeding 30 tonne for each leg) the holder plate will break immediately. The holder plate is made of such composite material (say fibre glass) that it can withstand gradual loading more than the rated load (say 60 tonne) but if the load acts as a sudden impact on the plate it will break instantly. Once the first upper set of holder plate (6) breaks, the top section of the arch will slide down to a certain length (say 300 mm) and will be held back by the lower second set of holder plates (6). If the shock wave occurs again, the subsequent set of lower holder plates will also break and the top portion will slide further down till the end of the bottom sections (1).

The main advantages of the present invention are:

1. It can yield 300 mm or more instantaneously under sudden impact load.
2. After a rapid yielding, it can again hold back the arch in a perfect position as usual such that it can again bear impending load to its capacity.
3. If there is no impact load, it can yield slowly beyond its yield load capacity tinder gradual loading.
4. It is very economic, as it is made by changing the clamp arrangement and introducing some guides and holder plates only with the existing U-section arch system.
5. It does not involve any running cost or maintenance cost in the system.
6. It can even be introduced with the existing arch supports without distribing the ongoing working and with an involvement of a little additonal cost.

What is claimed is:

1. An arch for withstanding the effects of rock burst occurring in underground mines/tunnels comprising:

a curved U-section top arch;

a U-section bottom arch piece slidably coupled to each side of said top arch, at least one guide on each side of said arch engaging said top arch and said bottom arch piece and slidably coupled to at least one of said top arch and said bottom arch piece;

an upper holder plate attached to each of said bottom arch pieces, the ends of the top arch resting on said upper holder plates; and a lower holder plate attached to each of said bottom arch pieces below said upper holder plate.

2. An arch as claimed in claim 1, wherein said holder plates are attached to said bottom arch pieces by nut and bolt arrangements.

3. An arch as claimed in claim 1, wherein said arch is made of steel.

4. An arch according to claim 1, wherein said upper holder plates are adapted to break when subjected to a sudden impact load in excess of a predetermined value.

5. An arch according to claim 4, wherein said upper holder plates are clamped to said bottom arch pieces such that the upper holder plates will move downwardly when subjected to a load in excess of a predetermined yield load during gradual loading of the top arch.

6. An arch according to claim 5, wherein said lower holder plates are adapted to break when subjected to a sudden impact load in excess of a predetermined value.

7. An arch according to claim 6, wherein said guides are fixed to said top arch and slidable relative to said bottom arch pieces.

8. An arch according to claim 4, wherein said lower holder plates are adapted to break when subjected to a sudden impact load in excess of a predetermined value.

9. An arch according to claim 8, comprising two guides on each side of said arch engaging said top arch and said bottom arch piece.

10. An arch according to claim 1, comprising two guides on each side of said arch engaging said top arch and said bottom arch piece.

* * * * *